US005947267A

United States Patent [19]

Kee et al.

[11] Patent Number: 5,947,267

[45] Date of Patent: Sep. 7, 1999

[54] ADJUSTABLE SWITCH ASSEMBLY

[75] Inventors: Cheah Chan Kee; Seong Jin Lim, both of Penang; Hari Narayanan S/o P. Ondiveeran, Perak, all of Malaysia

[73] Assignee: Motorola, Inc., Schaumburg, Ill.

[21] Appl. No.: 08/975,509

[22] Filed: Nov. 21, 1997

[51] Int. Cl.[6] ..... H01H 3/02

[52] U.S. Cl. ..... 200/332; 200/81 H; 200/335; 200/553

[58] Field of Search ..... 200/1 B, 5 R, 200/17 R, 18, 81 H–83 Z, 332, 335, 341–345, 553

[56] References Cited

U.S. PATENT DOCUMENTS

| | | | |
|---|---|---|---|
| 3,210,486 | 10/1965 | Holzer | 200/18 |
| 3,772,490 | 11/1973 | Thordarson | 200/81 H |
| 4,063,056 | 12/1977 | Baker | 200/332 |
| 4,263,489 | 4/1981 | Bergeson | 200/81 R |
| 4,493,957 | 1/1985 | Watters | 200/81 R |
| 5,155,308 | 10/1992 | Blair | 200/61.52 |
| 5,393,945 | 2/1995 | Joyce et al. | 200/81 R |
| 5,430,261 | 7/1995 | Malone | 200/5 R X |
| 5,495,079 | 2/1996 | Joyce | 200/81 R |
| 5,735,390 | 4/1998 | Takagi et al. | 200/344 |

*Primary Examiner*—J. R. Scott
*Attorney, Agent, or Firm*—Dale W. Dorinski

[57] ABSTRACT

A switch assembly which has a mount (12), an elongate member (14), a switch (16) and a fulcrum (18). Pressing on elongate member (14) provides a force to actuate switch (16). Elongate member (14) is resilient or, alternatively, is resiliently biased to return to an unactuated position. Fulcrum (18) is movable along a length of elongate member (14). Positions of fulcrum (18) along the length enables variation of the force to actuate switch (16). As a result of this variation, different tactile feel of the switch assembly can be provided depending on position of fulcrum (18) relative to switch (16). Fulcrum (18) can also be positioned along elongate member (14) to provide a locking position that prevents switch (16) from being actuated.

10 Claims, 2 Drawing Sheets

ADJUSTABLE SWITCH ASSEMBLY

FIELD OF THE INVENTION

This invention relates to switch assemblies. In particular, this invention relates to, but is not necessarily limited to, an adjustable switch assembly.

BACKGROUND OF THE INVENTION

Electronic devices with switch assemblies are known. These switch assemblies are for users to actuate switches associated with controllable features of the electronic devices. For example, a communication radio typically has a switch assembly that is commonly referred to as a press-to-talk (PTT) button. This PTT button can be actuated by a radio user to enable communication with other radio users within a radio communication system.

A certain amount of tactile force is required to actuate such a PTT button effectively. This force is generally constant for radios operating with switch assemblies of a similar design or type. However, because the force is not variable, different users may not find a PTT button suitable for their use. For example, one user may find that the PTT button responsive and has a good tactile feel whereas another user may find the same PTT button stiff with a poor tactile feel. Differences in tactile feel can cause some users to be unaware of actuation of a PTT button and this can cause problems such as inadvertent switch actuation or intermittent communication with other radio users.

SUMMARY OF THE INVENTION

It is an object of this invention to overcome or at least alleviate at least one of the problems associated with switch assemblies.

According to one aspect of the invention, there is provided a switch assembly comprising:

a mount;

an elongate member associated with said mount;

a switch associated with said mount and positioned to be actuated by said elongate member; and a fulcrum movable along a length of said elongate member such that positions of said fulcrum along said length varies a force to actuate said switch.

BRIEF DESCRIPTION OF THE DRAWINGS

In order to describe the invention and to put it into practical effect, reference will now be made to preferred embodiments as illustrated with reference to the accompanying drawings in which.

DETAILED DESCRIPTION OF THE INVENTION

Figure 1:
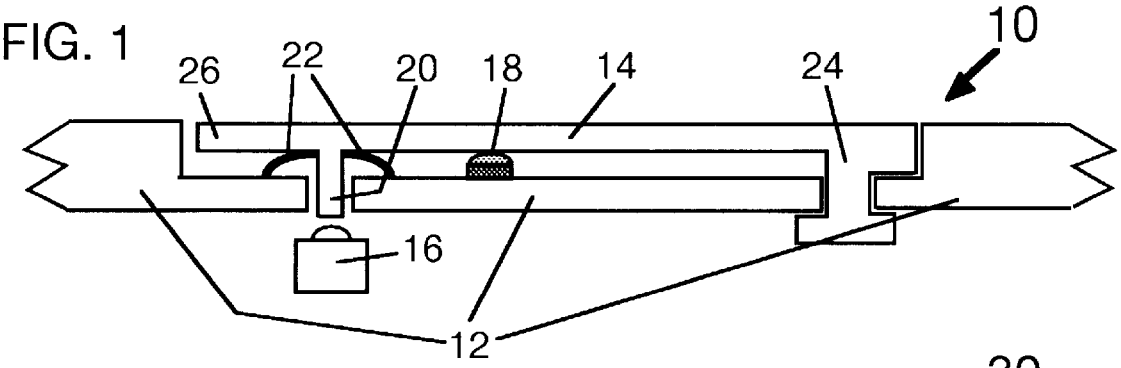
FIG. 1 is a cross-sectional side view of a switch assembly in accordance with a first preferred embodiment of the invention.

FIG. 1 is a side view of a switch assembly 10 in accordance with a first preferred embodiment of the invention. Switch assembly 10 comprises a mount 12, an elongate member 14, a switch 16 and a fulcrum 18. Elongate member 14 and switch 16 are associated with mount 12. Fulcrum 18 is movable along a length of elongate member 14. Switch 16 is positioned to be actuated by a protrusion 20 of elongate member 14. Protrusion 20 engages switch 16 when elongate member 14 is pressed by a user. A resilient member 22 is associated with protrusion 20 to return elongate member 14 to an unactuated position. Resilient member 22 also provides a locking position in which fulcrum 18 abuts resilient member 22. This locking position prevents switch 16 from being actuated when the user presses on elongate member 14.

In the first preferred embodiment of FIG. 1, elongate member 14 has a mounted end 24 and a free end 26. Fulcrum 18 is movable along a length of elongate member 14 between mounted end 24 and free end 26. Fulcrum 18 is slidably mounted on mount 12 or, alternatively, on elongate member 14. Switch 16 is disposed between fulcrum 18 and free end 26.

Positions of fulcrum 18 along the length of elongate member 14 varies a force to actuate switch 16. Variation of this force advantageously enables the invention to provide different tactile feel to users of switch assembly 10. Furthermore, the locking position prevents inadvertent actuation of switch 16 when so desired by a user. As the locking position uses fulcrum 18, no separate mechanism or -elements are needed. Hence, use of switch assembly 10 as a press-to-talk (PTT) button can therefore allow users to vary responsiveness of the PTT button.

Figure 2:
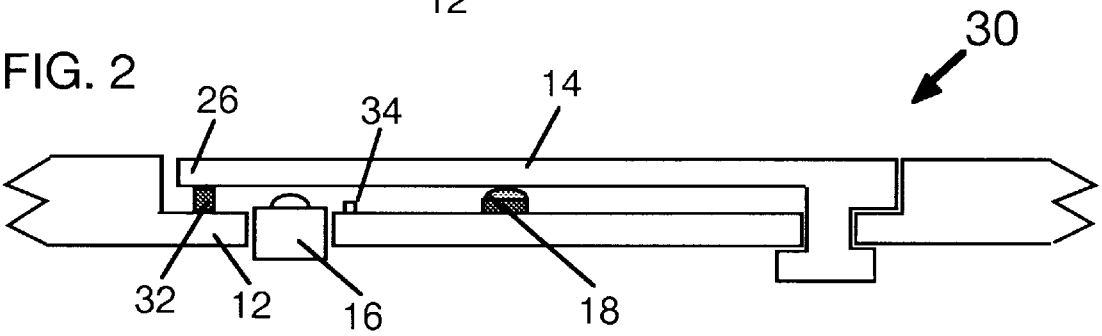
FIG. 2 is a cross-sectional side view of a switch assembly in accordance with a second preferred embodiment of the invention.

FIG. 2 is a side view of a switch assembly 30 in accordance with a second preferred embodiment of the invention. In switch assembly 30, a resilient member 32 couples free end 26 to mount 12 and resiliently biases elongate member 14 to return to an unactuated position after engagement of switch 16. Switch assembly 30 also comprises a stopper 34 which provides a locking position. When fulcrum 18 is abutting or in close proximity to stopper 34, switch 16 is prevented from actuation when the user presses on elongate member 14.

Figure 3:
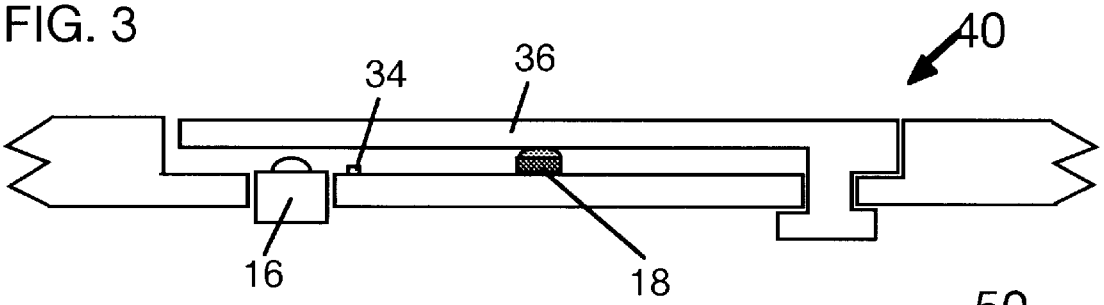
FIG. 3 is a cross-sectional side view of a switch assembly in accordance with a third preferred embodiment of the invention.

FIG. 3 is a side view of a switch assembly 40 in accordance with a third preferred embodiment of the invention. An elongate member 36 in this embodiment is resilient for actuation of switch 16. Hence, no separate resilient member is required as in the first and second preferred embodiments. As in switch assembly 30, a stopper 34 is disposed on mount 12 to enable a locking position.

Figure 4:
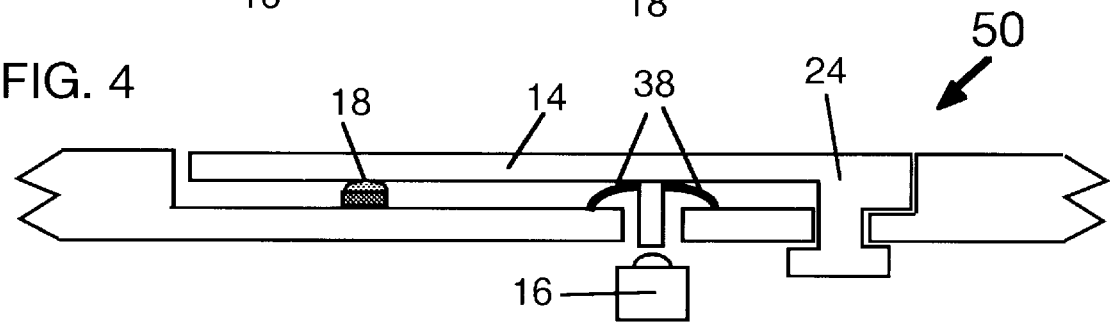
FIG. 4 is a cross-sectional side view of a switch assembly in accordance with a fourth preferred embodiment of the invention.

A fourth preferred embodiment is shown in FIG. 4 wherein a switch assembly 50 has switch 16 disposed between fulcrum 18 and mounted end 24. Resilient member 38 resiliently bias elongate member 14 to return to an unactuated position.

Figure 5:
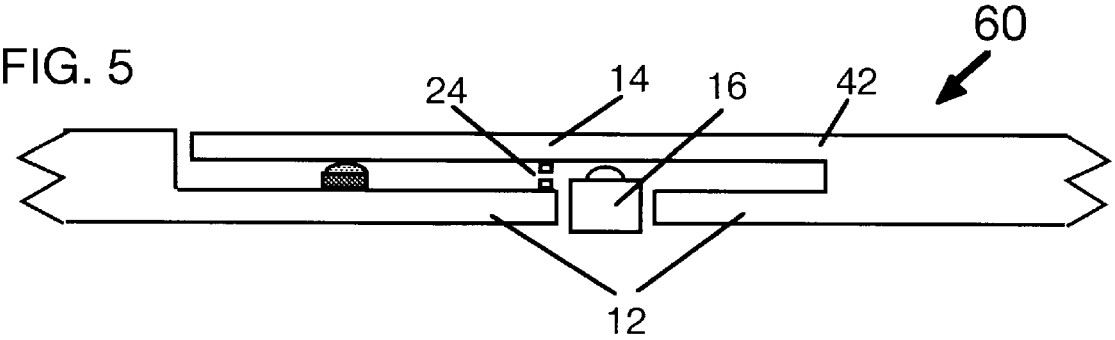
FIG. 5 is a cross-sectional side view of a switch assembly in accordance with a fifth preferred embodiment of the invention.

In a fifth preferred embodiment of the invention as shown in FIG. 5, a switch assembly 60 has elongate member 14 integral with mount 12. Elongate member and extends from a fixed end 42 of mount 12. Switch 16 is disposed between fulcrum 18 and fixed end 42. Elongate member 14 is resilient for actuation of switch 16 when pressed by a user.

Figure 6:
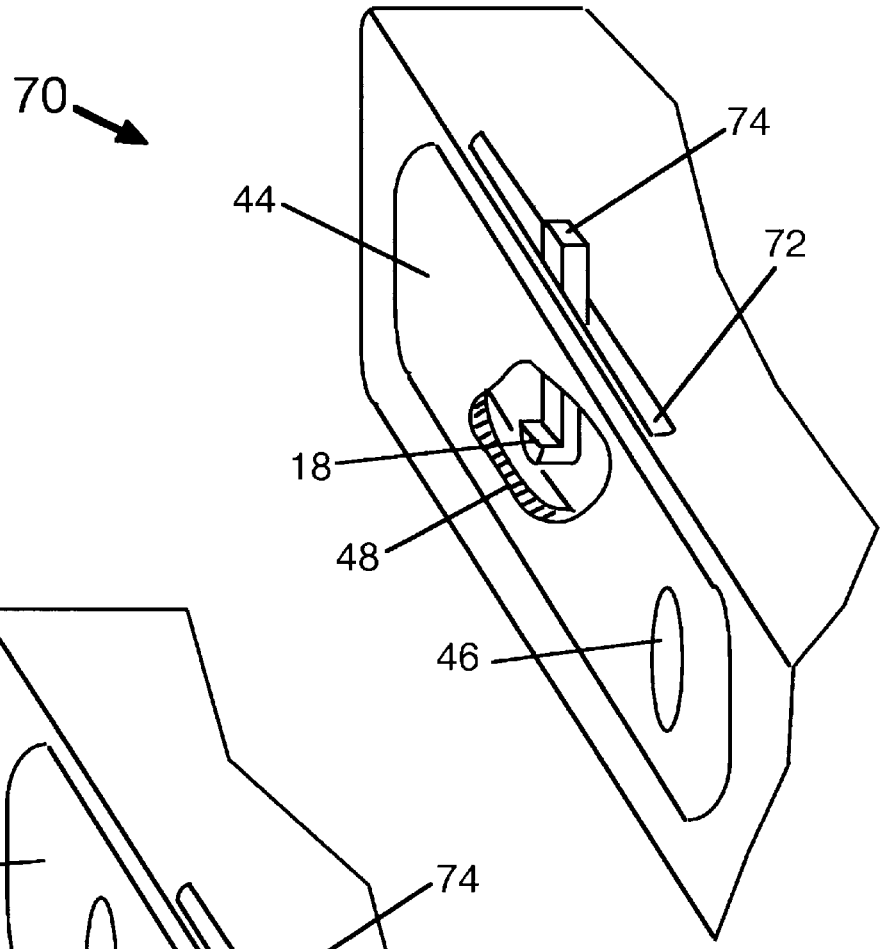
FIG. 6 is an external perspective view of part of an electronic device with the switch assembly in accordance with the preferred embodiments of FIGS. 1 to 3.
Figure 7:
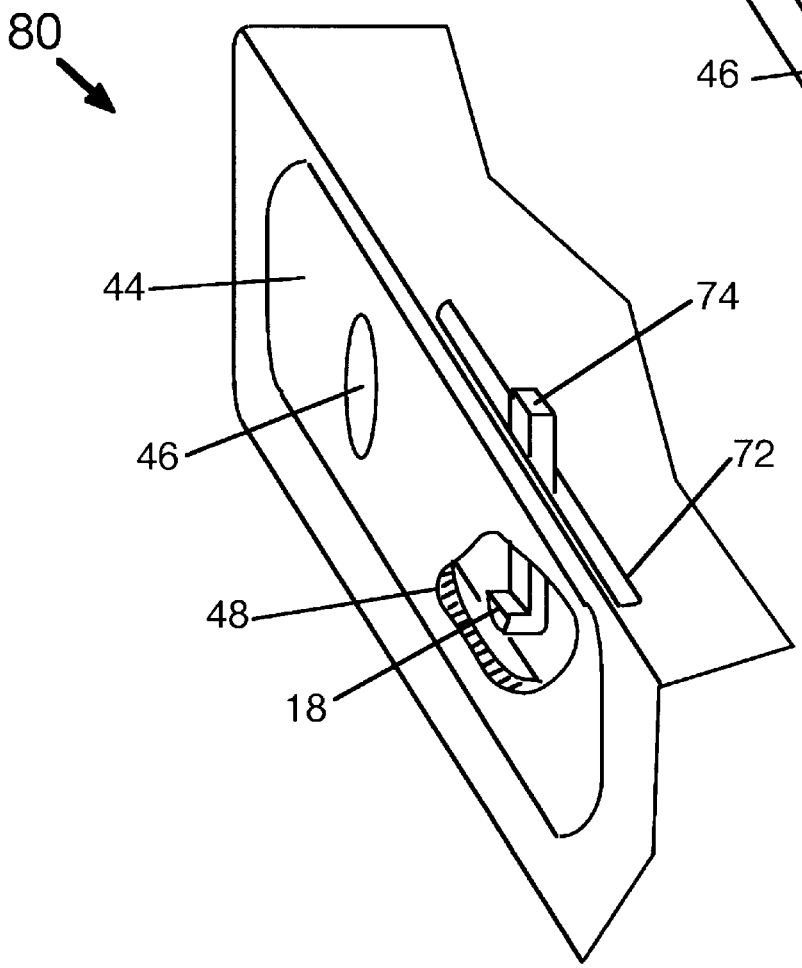
FIG. 7 is an external perspective view of part of an electronic device with the switch assembly in accordance with the preferred embodiments of FIGS. 4 & 5.

FIGS. 6 and 7 are external perspective views of part of an electronic device 70,80 with switch assemblies in accordance with the above preferred embodiments. Switch assemblies 10,30,40 can be applied as shown in electronic device 70 and switch assemblies 50,60 can be applied as shown in electronic device 80. Part of a housing for electronic device 70,80 serves as mount 12 when the invention is applied as illustrated in FIGS. 6 and 7. Position 44 shows the external position of mounted end 24 and a pad 46 indicates location for actuation of switch 16 within electronic device 70,80. Further shown in FIGS. 6 and 7 is a cut-off section 48 of the housing to thereby expose fulcrum 18. The housing includes a slot 72 from which an actuating portion 74 of fulcrum 18 extends. Actuating portion 74 is integrally molded with fulcrum 18 and is user-movable for relative movement along slot 72. This relative movement correspondingly moves fulcrum 18 along the length of elongate member 14.

The invention as described above is advantageously applied to electronic device 70,80 such as a communication radio. Hence, the invention serves as an adjustable PTT button for actuating switch 16 to enable communication by a user of the communication radio with users of other communication radios within a radio communication system. Such an adjustable PTT button as provided by the invention allows the user to select an appropriate tactile feel so that switch 16 can be effectively actuated. This, therefore, advantageously alleviates inadvertent switch actuation or intermittent communication when using the communication radio.

We claim:

1. A switch assembly comprising:

a mount;

an elongate member associated with said mount; and a fulcrum, slidably coupled to said elongate member, said fulcrum being movable along a length of said elongate member such that positions of said fulcrum along said length varies a force on said elongate member to actuate a switch within said mount.

2. The switch assembly as claimed in claim 1 wherein said elongate member is resilient and coupled to said mount.

3. The switch assembly as claimed in claim 1 wherein said elongate member is resiliently biased and coupled to said mount.

4. The switch assembly as claimed in claim 1 wherein said elongate member comprises a mounted end and a free end, said fulcrum being movable between said mounted end and said free end.

5. The switch assembly as claimed in claim 4 wherein said switch is disposed between said free end and said fulcrum.

6. The switch assembly as claimed in claim 4 wherein said switch is disposed between said mounted end and said fulcrum.

7. The switch assembly as claimed in claim 1 wherein said elongate member comprises a protrusion for engaging said switch.

8. The switch assembly as claimed in claim 1 wherein said elongate member is integral with said mount.

9. The switch assembly as claimed in claim 1 wherein said mount comprises at least one stopper for enabling a locking position to prevent actuation of said switch when said fulcrum abuts said stopper.

10. The switch assembly as claimed in claim 1 wherein said mount is part of a housing for an electronic device.

* * * * *